US008707725B2

(12) United States Patent
Camacho Velázquez

(10) Patent No.: US 8,707,725 B2
(45) Date of Patent: Apr. 29, 2014

(54) ICE MAKING DEVICE WITH TANK

(75) Inventor: Alan Federico Camacho Velázquez, Santiago de Queretaro (MX)

(73) Assignee: Mabe, S.A. de C.V., Queretaro (MX)

( * ) Notice: Subject to any disclaimer, the term of this patent is extended or adjusted under 35 U.S.C. 154(b) by 170 days.

(21) Appl. No.: 13/461,986

(22) Filed: May 2, 2012

(65) Prior Publication Data

US 2012/0279246 A1 Nov. 8, 2012

(30) Foreign Application Priority Data

May 4, 2011 (MX) ..... MX/a/2011/004880

(51) Int. Cl.
*F25C 1/00* (2006.01)
*F25D 23/04* (2006.01)
*F25C 1/08* (2006.01)

(52) U.S. Cl.
USPC ..... 62/340; 62/344; 62/377; 62/345

(58) Field of Classification Search
USPC ..... 62/340, 344, 347
See application file for complete search history.

(56) References Cited

U.S. PATENT DOCUMENTS

| | | | | |
|---|---|---|---|---|
| 3,412,572 | A * | 11/1968 | Kesling | 62/344 |
| 4,222,547 | A * | 9/1980 | Lalonde | 249/120 |
| 5,855,225 | A * | 1/1999 | Williams, III | 137/535 |
| 6,167,717 | B1 * | 1/2001 | Dudley et al. | 62/291 |
| 2005/0160757 | A1 * | 7/2005 | Choi et al. | 62/344 |
| 2009/0000330 | A1 * | 1/2009 | Choi | 62/344 |
| 2009/0178431 | A1 * | 7/2009 | Cho | 62/345 |
| 2009/0314024 | A1 * | 12/2009 | Choi | 62/347 |
| 2010/0192614 | A1 * | 8/2010 | Kim et al. | 62/344 |

* cited by examiner

*Primary Examiner* — Cassey D Bauer
*Assistant Examiner* — Steve Tanenbaum
(74) *Attorney, Agent, or Firm* — Enrique J. Mora; Beusse Wolter Sanks Mora & Maire, P.A.

(57) ABSTRACT

An ice making device with a manually removable water tank is provided. When mounted, this tank has a system for opening a valve that allows dispensing water into an ice making tray of the ice making device. The ice making tray is rotatable so that the ice cubes formed in the tray can be removed. The ice making tray may be rotated by a pair of gears, one of them holds the ice making tray in position and transmits a rotation force to the tray; this gear has a preload spring which generates an appropriate return force. The other gear is part of the lever, giving torsion to the tray and may be operated by a user. When rotating the tray, the ice cubes may fall directly into an ice bucket which can be removed from the system to externally serve ice.

18 Claims, 29 Drawing Sheets

ICE MAKING DEVICE WITH TANK

RELATED APPLICATIONS

This application claims priority from Mexican Application Serial No. MX/a/2011/004880 filed May 4, 2011, which is incorporated herein by reference in its entirety.

FIELD OF THE INVENTION

The present invention refers to an ice making device with a detachable tank for automatic water supply. Said ice making device is designed to be detachably mounted inside the freezing compartment of a domestic refrigerator. More particularly, it refers to an ice making device similar to those having an ice making tray that is rotated by a drive transmission mechanism.

BACKGROUND ART

Usually, ice making devices are mounted inside the freezing compartment of an ordinary refrigerator in order to facilitate the making and dispensing of ice cubes. Previously, ice making devices consisted of ice making trays arranged in various arrays within a support structure that had to be manually removed and filled directly by the user. These trays could be rotated to remove the ice in them by means of simple independent knobs attached to each of them. Nowadays, particularly the systems to fill and rotate the trays for the release of ice cubes have been improved as shown in the following documents of the state of the art.

For example, the United States Application No. 2008/0006048 A1 discloses an ice tray assembly for ice making which mainly comprises: an outer case, an inner case mounted in a sliding manner on the outer case, two ice making trays arranged within the inner case, a gear mechanism actuated by a lever to rotate the trays, and a detachable water tank mounted on the upper portion of the outer case. In said assembly, water is supplied to the trays from the water container by means of a valve manually actuated by a lever, resulting impractical for the user since he/she needs to keep activating said mechanism while filling said trays. Additionally, it includes a system of chutes and pipes to guide the water into the trays, making this assembly considerably more complex and, therefore, more expensive. Moreover, said valve element does not include a system to prevent any waste of water to become stagnant and accumulate near the valve element, even in small quantities, this water could freeze causing a bad seal of said valve and, therefore, an assembly malfunction. Lastly, the trays are permanently assembled inside the inner case; therefore, they cannot be detached from the same, making it difficult for cleaning and/or maintenance purposes.

Furthermore, the United States Application No. 2009/0314024 A1 discloses and ice making apparatus which comprises a case with an ice making chamber, two trays installed so that they rotate inside the ice making chamber, a tray driving mechanism made up of a series of gears and an actuation lever, a water tank disposed separately from the case and arranged in a fixed and isolated way on the freezer door. In said apparatus, water is supplied to the trays from the fixed tank through a valve actuated by an electrical lever and through a system of chutes and pipes to guide the water into the trays, making this assembly considerably more complex and, therefore, more expensive. Particularly, this apparatus is intended to solve the vortex or maelstrom phenomenon in the water inside the pipes leading to the trays, whereby a series of guiding tabs or protrusions are arranged along said pipes to prevent water from flowing in a circumferential direction inside them. Therefore, this apparatus does not include a water supply system with any characteristic to prevent water waste to accumulate near the valve element; this water waste could freeze causing a bad seal of the valve and, thus, an apparatus malfunction. Moreover, the trays are permanently assembled inside the inner case; therefore, they cannot be detached from the same, making it difficult for cleaning or maintenance purposes.

The United States Application No. 2009/0178431 A1 discloses an ice making unit which comprises an ice making case, a plurality of trays rotably installed inside the ice making case, a device to separate ice cubes from the trays by rotation of the trays made by a series of gears and an actuation lever, a detachable tank for water supply disposed above the trays to store the water supplied to the same, and an ice cube storage container below said trays. In said unit, water is supplied to the trays from the detachable tank (previously filled) through a valve automatically actuated by a protrusion on the case, once the tank is fully installed in place inside said case, and through a system of chutes and pipes to guide the water into the trays, making this assembly considerably more complex and, therefore, more expensive. Particularly, this apparatus does not include a water supply system from the tank to the trays with a characteristic to prevent any water waste to accumulate particularly near the valve or the tank outlet openings; this water waste could freeze causing a bad seal of the valve and, therefore, an apparatus malfunction. Together with the previous statements, although in this case, the trays are detachably mounted inside the case, they have to be assembled again in the same way in which they were removed since the rotating shafts built at the end of said trays are not symmetrical, which requires additional care from the user.

Hence, based on the above statements, there exists a need for an ice making device that effectively and reliably resolves the drawbacks present in the art previously described.

BRIEF DESCRIPTION OF THE INVENTION

The present invention has been made in order to provide an effective solution to the problems of the state of the art previously mentioned.

An aspect of the present invention is to provide an ice making device with a detachable tank that can be mounted easily and detachably on the inner case or liner inside the freezing compartment of a domestic refrigerator.

Another aspect of the present invention is to provide an ice making device with a detachable tank that allows manually filling the tank from outside the freezing compartment in a practical way, so that it can be placed back in the device for automatic supply onto the ice making trays.

Another aspect of the present invention is to provide an ice making device with a detachable tank that comprises a drive transmission mechanism for rotation of the ice making trays, whereby said mechanism is easy to operate, of simple construction and performs efficiently to be able to separate the ice cubes from the tray.

Another aspect of the present invention is to provide an ice making device with a detachable tank, in which the ice making tray can be detached from the main case in order to facilitate cleaning and maintenance; and whereby said tray also has, symmetrically on both sides, a portion of the central rotating shaft and a decentralized cam follower element, thus allowing to fit said tray indistinctly back on the case.

Another additional aspect of the present invention is to provide an ice making device with a detachable tank, in which the water supply system from the container tank to the ice making tray has specially designed characteristics to prevent water waste to accumulate particularly near the valve or tank outlet opening, preventing said water waste from freezing, thus causing a bad seal of the valve and, therefore, an apparatus malfunction.

Specifically, the present invention refers to an ice making device that is designed to be detachably mounted in the inner side or liner inside the freezing compartment of a domestic refrigerator. More specifically, it refers to an ice making device similar to those having a detachable tank to hold the water for later filling of the ice making tray. Said ice making device mainly comprises: a main case structure preferably with a substantially parallelepiped shape, with a hinged door coupled at the front; an ice making tray detachably disposed inside said case structure; an ice cube container mounted in a sliding manner at the bottom of the case structure; a drive transmission mechanism which allows the rotation of said ice making tray in a predetermined angle and whereby said drive transmission mechanism is made up of a manually actuated lever, pivotally coupled from one of its ends to the case structure and it has a first gear element integrally formed on said end of the lever, and a second gear element coupled on one side to the said first gear element in a serrated way and on another side to said ice making tray; and a detachable tank, mounted in a sliding manner to the upper portion of said case structure, that is used to hold water and, once mounted in its place in said case structure, to automatically supply water directly into the ice making tray through a drain opening at the bottom of said tank.

The supply of water to the tray through said drain opening is controlled by a plug valve coupled in a hinged way to the bottom portion of the detachable tank and it is held in close position due to the force exerted by a torsion spring attached to the same, until said force is overcome once a cam-type protrusion arranged in said case structure comes in contact with a portion of said valve pushing it upwards to an open position, when the tank is coupled to the case structure.

Additionally, said plug valve has at least one water diversion flap arranged on its body to prevent water waste from the same to come in contact with the torsion spring preventing its freezing.

Moreover, the tank drain opening comprises a tubular element that extends downwards and has an angular cut on its end; said element is used to guide the discharge of water in only one direction, thus preventing water spread outside the tray. Furthermore, said tubular element has at least one channel-type groove or recess longitudinally formed along it, in order to prevent water waste to be stuck in said tubular element due to capillary effects.

Additional aspects and advantages of the present invention will become apparent upon reference of the description taken in conjunction with the following drawings.

BRIEF DESCRIPTION OF THE DRAWINGS

Specific characteristics and advantages of the invention, as well as further aspects of the invention will become apparent from the following description, taken in conjunction with the accompanying figures, in which.

DETAILED DESCRIPTION OF THE INVENTION

Figure 1:
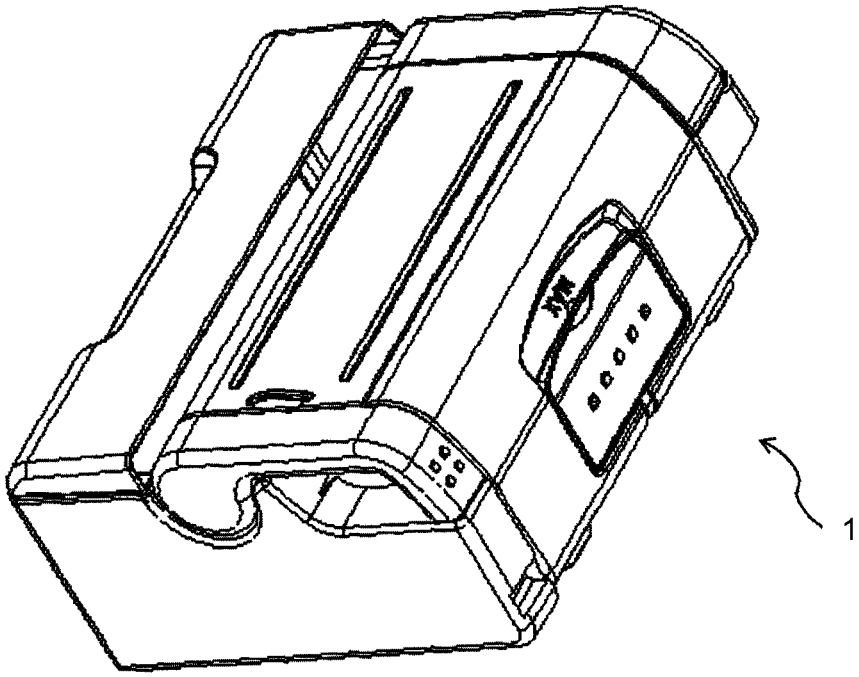
FIG. 1 shows a conventional perspective view of the ice making device with tank completely assembled according to the present invention.
Figure 2:
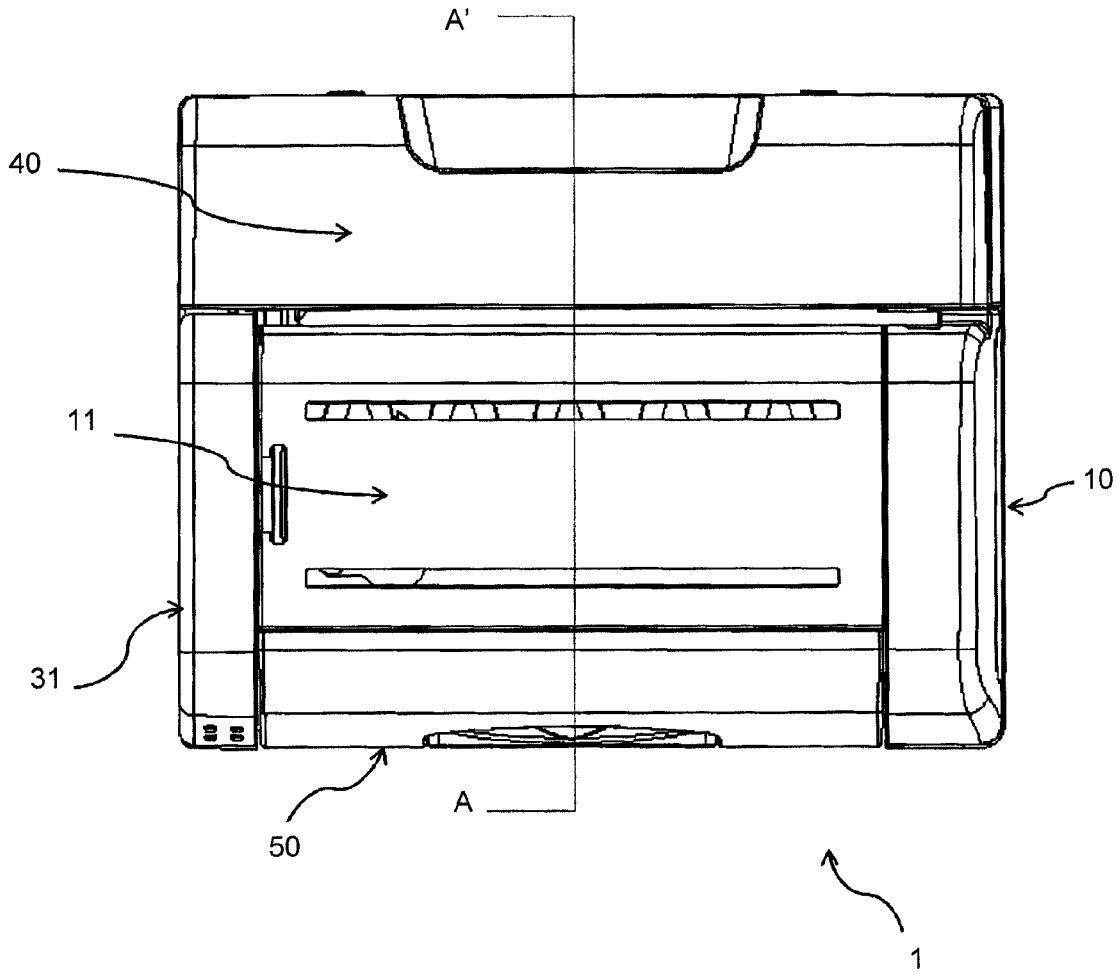
FIG. 2 shows a front view of the ice making device of FIG. 1.

The present invention refers to an ice making device that is designed to be detachably mounted inside the inner case or liner of the freezing compartment of a domestic refrigerator. More particularly, it refers to an ice making device similar to those having a detachable tank to hold the water that will later be used to fill the ice making tray.

As shown in FIGS. 1 to 12, the ice making device (1) is comprised of a series of main elements coupled to each other and that interact effectively to perform the function of the same, as it is explained below.

Initially, the device has a main case structure (10) which, preferably, has a substantially parallelepiped shape and acts as main support structure for the ice making device (1). Said main case structure (10) can be made of any adequate rigid polymeric material, such as polycarbonate, polyethylene, polystyrene, etc. Moreover, it has a hinged door (11) coupled at the front to allow or block access to the inside of the case (10), and it has a latch or lock media (12) for fastening. As it can be better observed in FIG. 12, a first lateral case cover (13) and a second lateral case cover (14) are coupled to the sides of the case structure (10) for the purpose of tightness and design. In a preferred embodiment, said hinged door (11) has at least one opening (15) on it to favor air circulation inside the case (10) and, therefore, in the ice making tray (20); moreover, various openings can be conveniently made in different sections of the case (10) with the same purpose.

Figure 19:
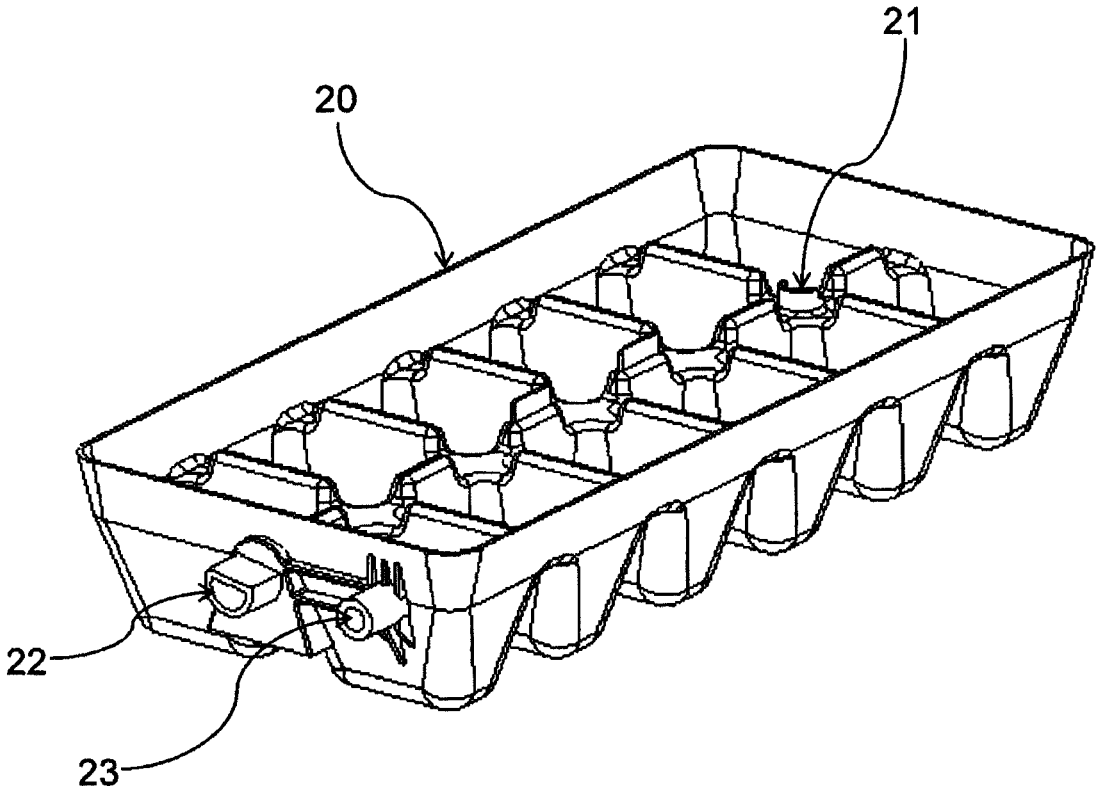
FIG. 19 shows a conventional perspective view of the ice making tray.
Figure 20:
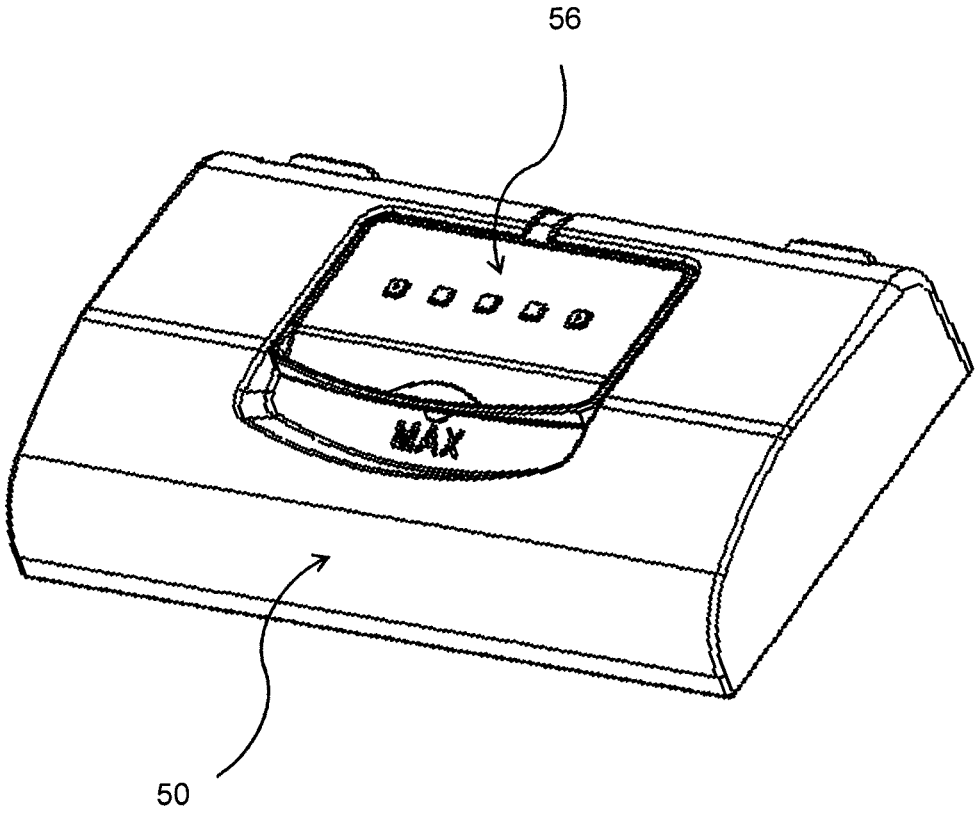
FIG. 20 shows a conventional perspective view of the detachable tank of the ice making device according to the present invention.
Figure 21:
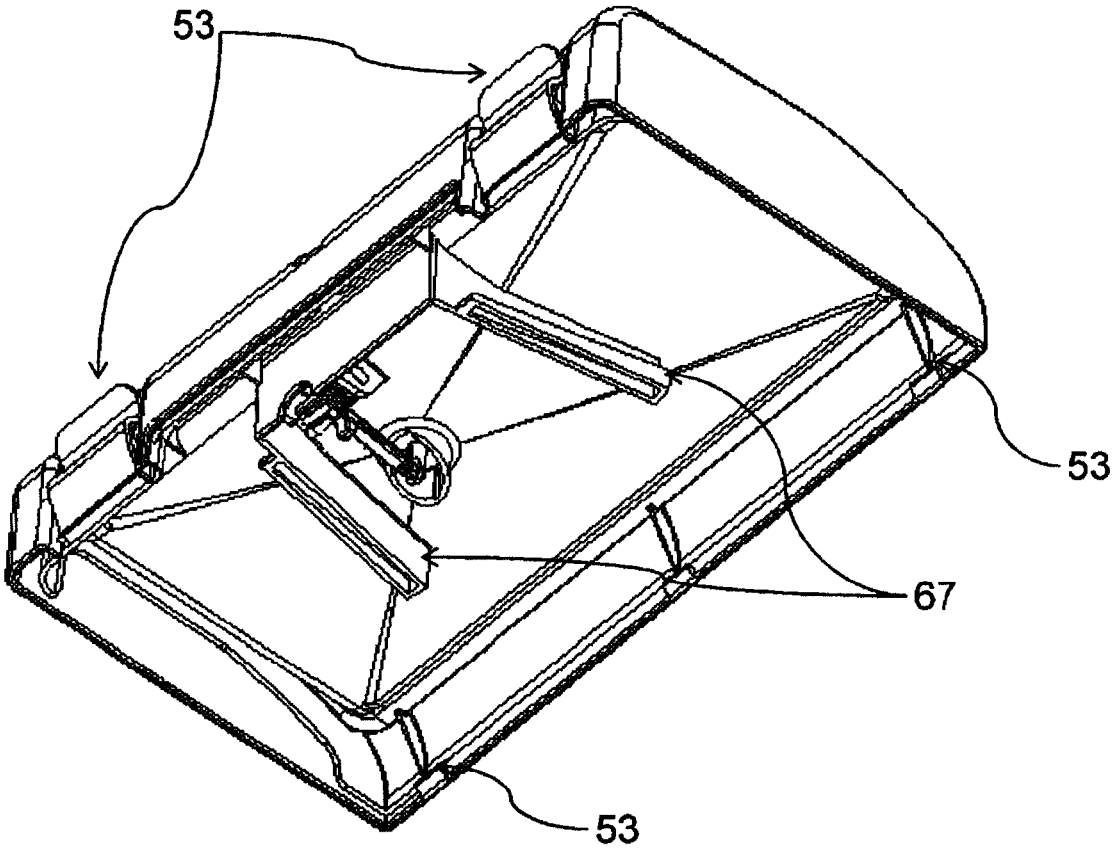
FIG. 21 shows a conventional perspective view of the bottom portion of the detachable tank of FIG. 20.
Figure 22:
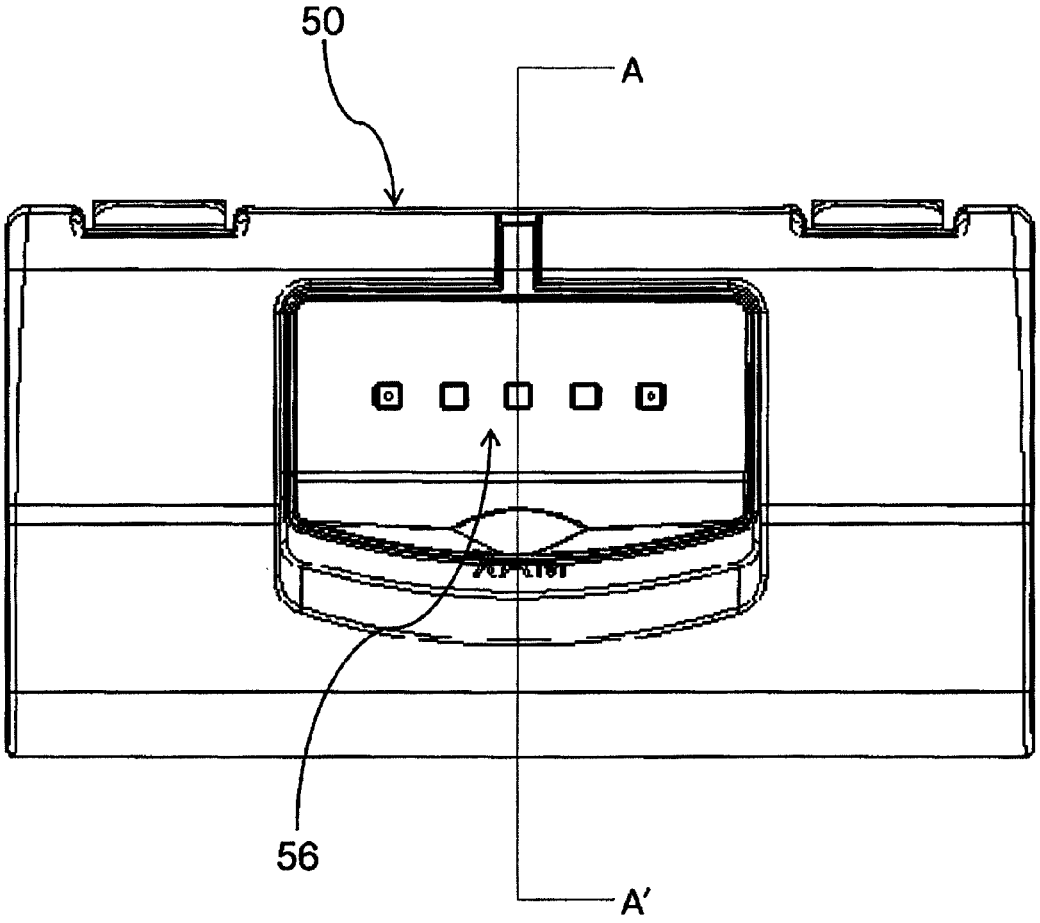
FIG. 22 shows a top view of the detachable tank of FIG. 20.
Figure 23:
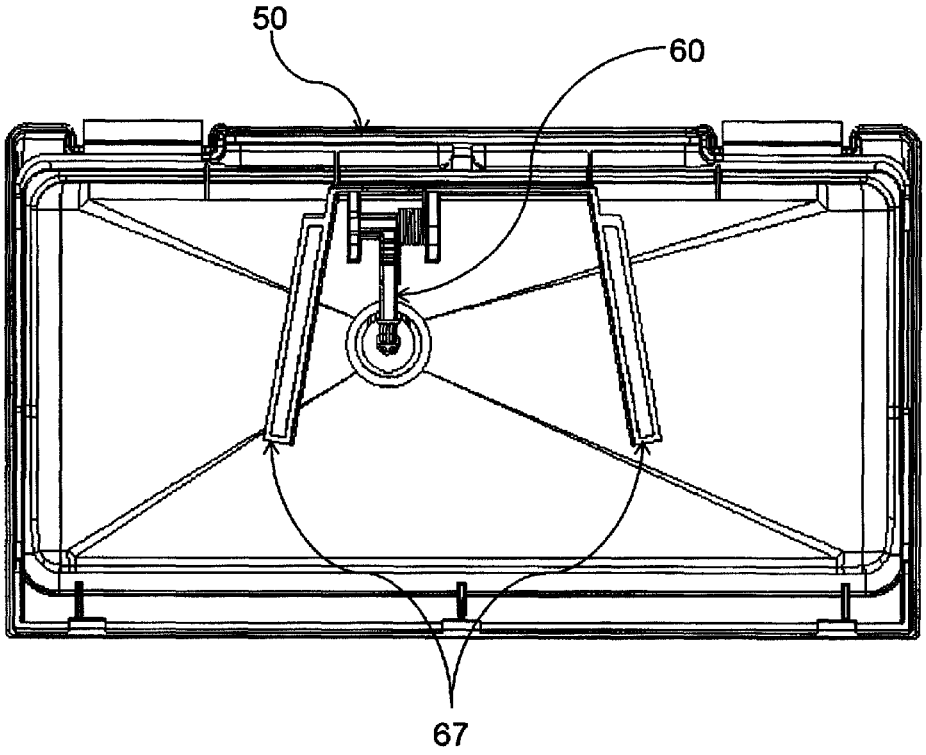
FIG. 23 shows a bottom view of the detachable tank of FIG. 20.
Figure 24:
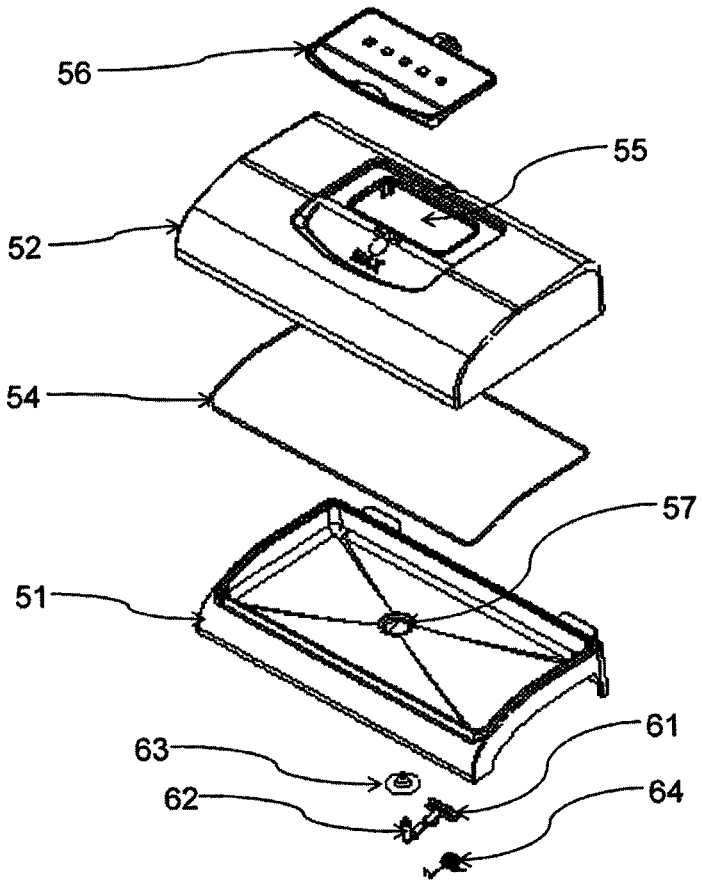
FIG. 24 shows a conventional exploded perspective view of the detachable tank of FIG. 20.
Figure 25:
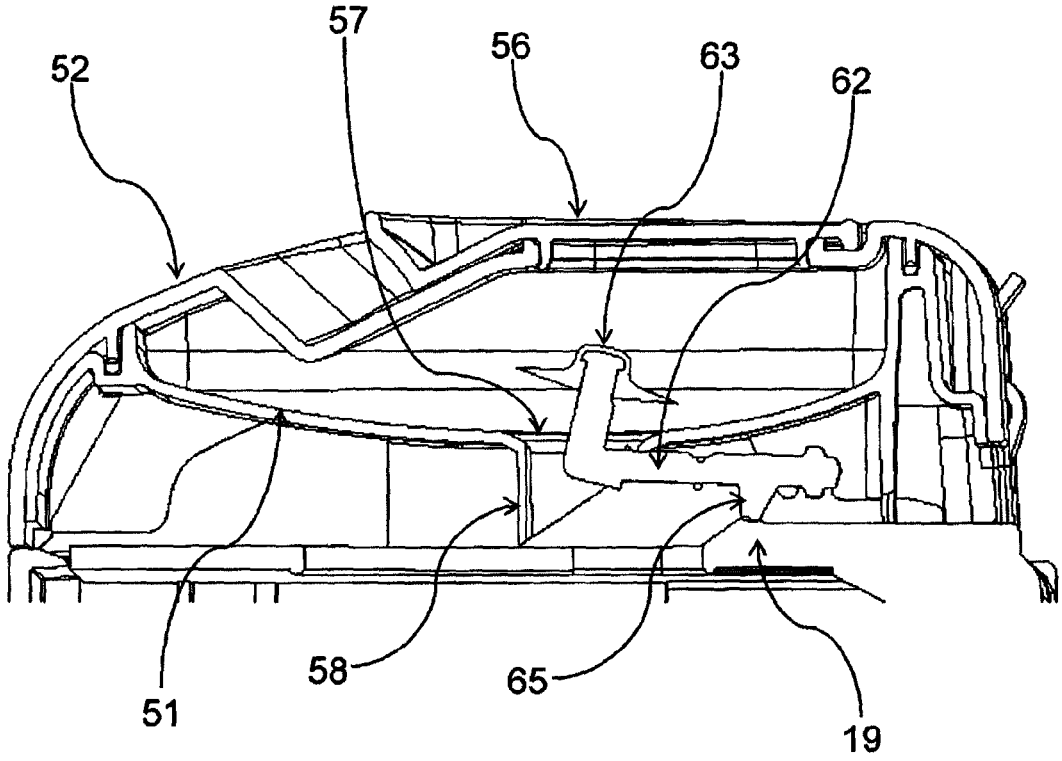
FIG. 25 shows a cross section view of the detachable tank taken along the lines A-A' of FIG. 22.
Figure 26:
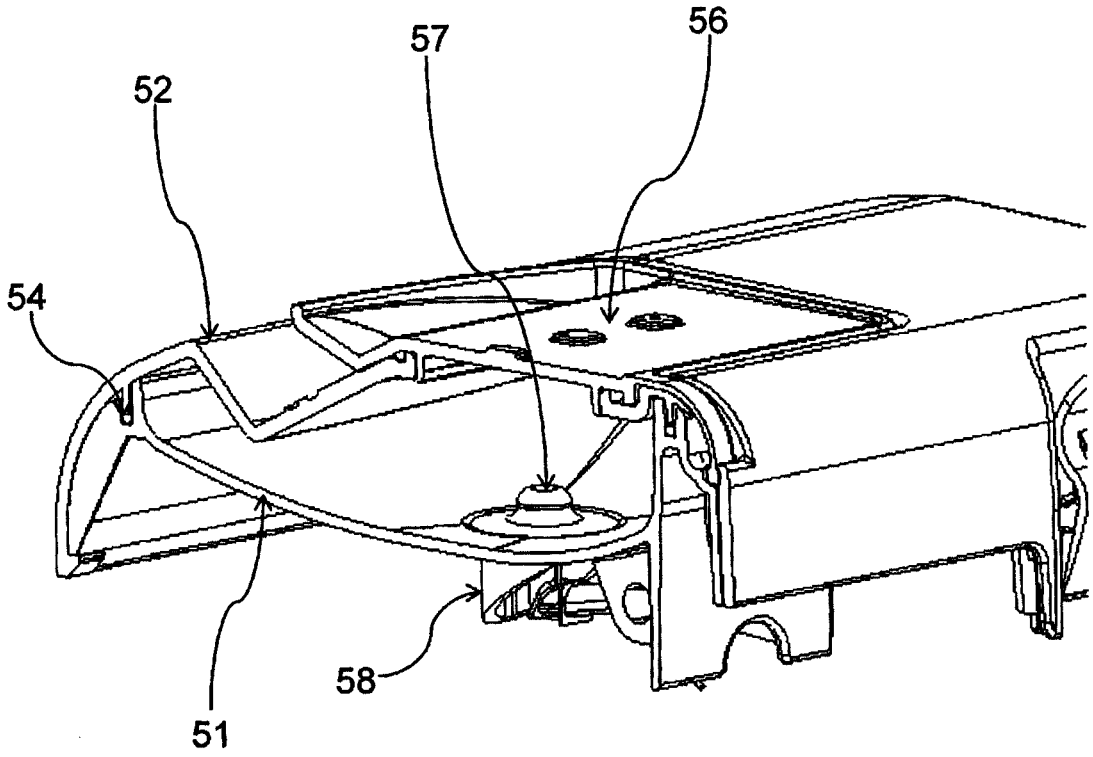
FIG. 26 shows a conventional perspective view of the cross section view of FIG. 25.

An ice making tray (20) is detachably disposed inside said case structure (10) so that it can be rotated in a predetermined angle, preferably between 140 and 160 degrees to facilitate the dispensing of ice cubes from it. Said tray (20) is preferably made up of an adequate semi-rigid polymeric material which allows additional torsion of the tray preferably in an angle between 20 and 30 degrees to facilitate even more the release of the ice cubes formed in it; additionally, it has at least one opening (21) on it to prevent overfilling. Furthermore, as it is shown in FIG. 19, the ice making tray (20) has a portion of the central rotating shaft (22) and a decentralized cam follower element (23) symmetrically and integrally formed on both ends; by means of these elements, one end is assembled to a lateral of the case (10) and the other end is assembled to a drive transmission mechanism (30).

Figure 18:
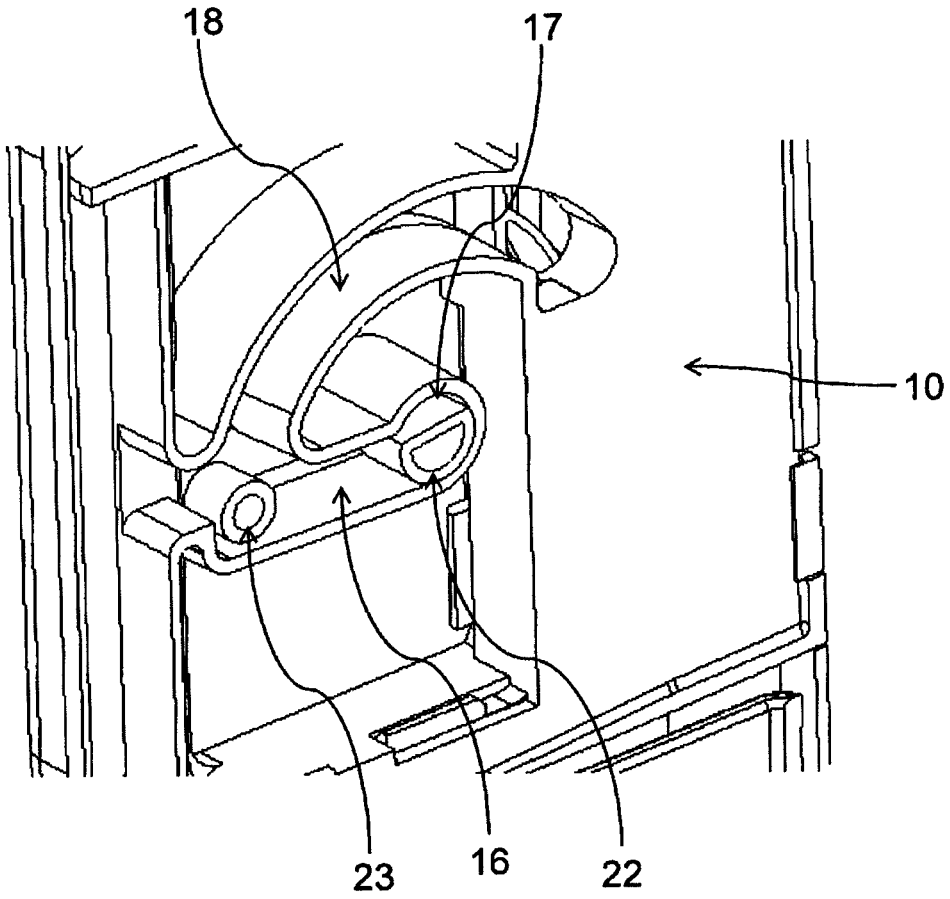
FIG. 18 shows a detailed view of the guiding channel formed on the main case to guide and stop the rotation of the ice making tray.

As it is shown particularly in FIG. 18, the assembly at the end of the tray (20) on the lateral of the case (10) is done by inserting both the central shaft portion (22) and the decentralized cam follower element (23) on a guiding channel (16) formed on said lateral of the case, so that the central shaft portion (22) abuts against the back of said guiding channel (16) whereby it is separately retained inside a semi-cylinder (17) for rotation; while the decentralized cam follower (23) remains in a position such that when the tray (20) is rotated, it covers a second guiding channel (18) formed on the lateral portion of the case (10) which has a semicircular path and serves to guide and stop the rotation of the tray (20) in the predetermined angle. It should be noted that the tray (20) is made symmetrically so that it can work properly regardless of the side on which it is arranged on the case (10).

Figure 17:
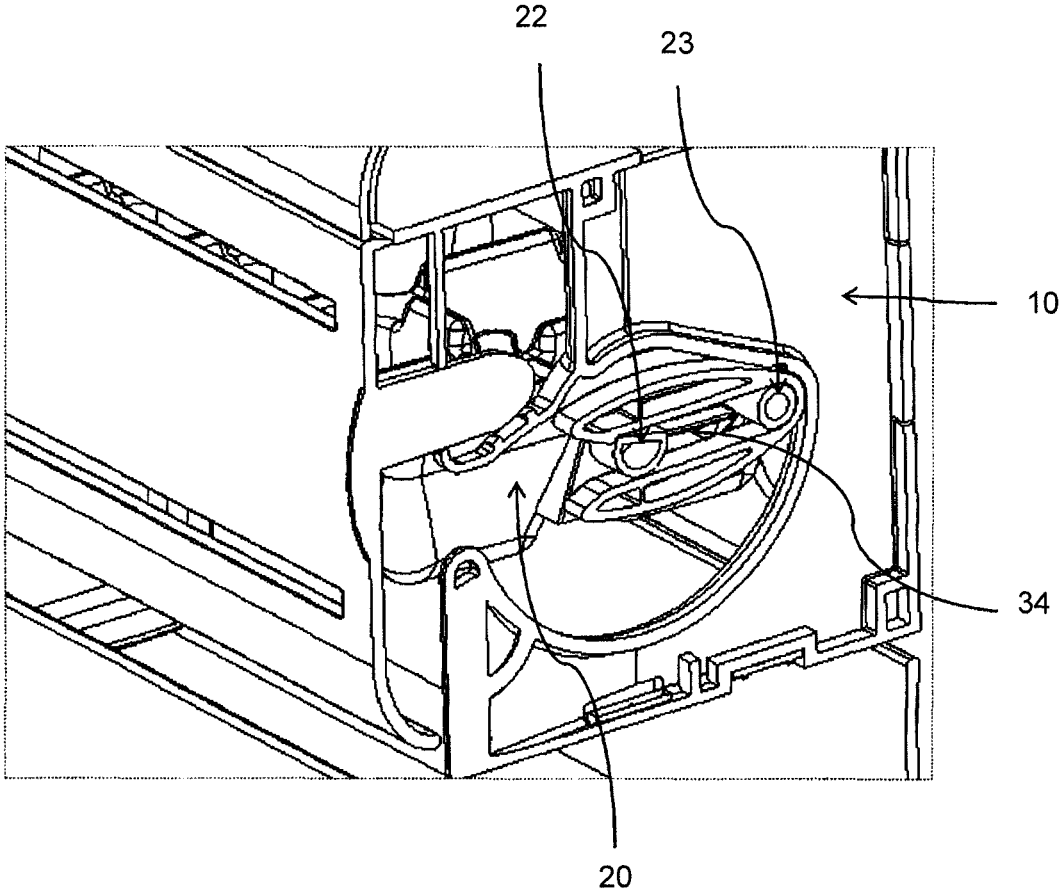
FIG. 17 shows a detailed view of the engagement of the ice making tray with the guiding channel formed at the rear portion of the second gear element of the drive transmission mechanism.

As it is shown in detail in FIG. 17, the end of the tray (20) that is assembled to the drive transmission mechanism (30) is made by inserting both the central shaft portion (22) and the decentralized cam follower element (23) of the end of the tray (20), inside a U-shaped channel (34) specially formed at the back portion of a second gear element (33) of said drive transmission mechanism (30), which is rotably coupled on the other lateral portion of the case (10).

Said drive transmission mechanism (30) allows the user to rotate the ice making tray (20) on a predetermined angle by means of a lever (31) (and if necessary, make an additional torsion twist to the same), in order to release the ice cubes formed in the tray. This drive transmission mechanism (30) is preferably coupled to a lateral portion of the case, and is made up of a manually actuated lever (31) pivotally coupled from one of its ends to the case structure (10); said lever (31) has a first gear element (32) integrally formed on said end of the lever coupled to the case (10). Said drive transmission mechanism (30) also comprises a second gear element (33) coupled on one side to the said first gear element (32) in a serrated way, and on another side to said ice making tray (20) through a U-shaped channel (34) specially formed on the back portion. Furthermore, said drive transmission mechanism (30) has a torsion spring (35) which exerts a push counterforce to return the mechanism to its initial position; said torsion spring (35) is preferably coupled to said second gear element (33); however, in an alternative embodiment, it can be coupled directly onto the lever (31).

Moreover, an ice cube container (40) is mounted in a sliding and detachable manner at the bottom portion of the case structure (10). Said container (40) is specially designed to receive and store the ice cubes formed in the ice making tray (20) once they are released from the tray when rotated through the drive transmission mechanism (30). The container (40) has a handle (41) to facilitate its removal and, in a preferred embodiment, it can have tracks or rails to facilitate sliding it in the case (10), as well as stoppers to hold it in a fixed desired position. In another preferred embodiment, said container can be designed to store approximately 1 kg of ice cubes.

Similarly, a detachable tank (50) is mounted in a sliding and removable manner to the upper portion of said case structure (10); said detachable tank (50) is specially used to hold water and, once mounted in its place in said case structure (10), to automatically supply water directly into the ice making tray (20). As FIGS. 20 to 26 show, the detachable tank (50) comprises a tray element (51) and a cover element (52) engaged to each other by means of clamping elements (53), preferably snap-on type such as flanges, clips, bolts or any other adequate element; providing a container space between them. A gasket or elastic O-ring seal (54) is arranged between both elements (51, 52) to ensure a tight seal between them. On the upper part of the cover element (52) there is a fill opening (55) through which the detachable tank (50) can be filled; said fill opening (55) can be closed by a cap (56) hold preferably in a hinged way to said cover (52). At the bottom portion of the tray element (51) there is a drain opening (57) through which the water is directly supplied to the ice making tray (20). Said water supplied through the drain opening (57) is controlled by a plug valve (60) coupled in a hinged way to the bottom portion of the tray element (51) of the detachable tank (50).

Figure 27:
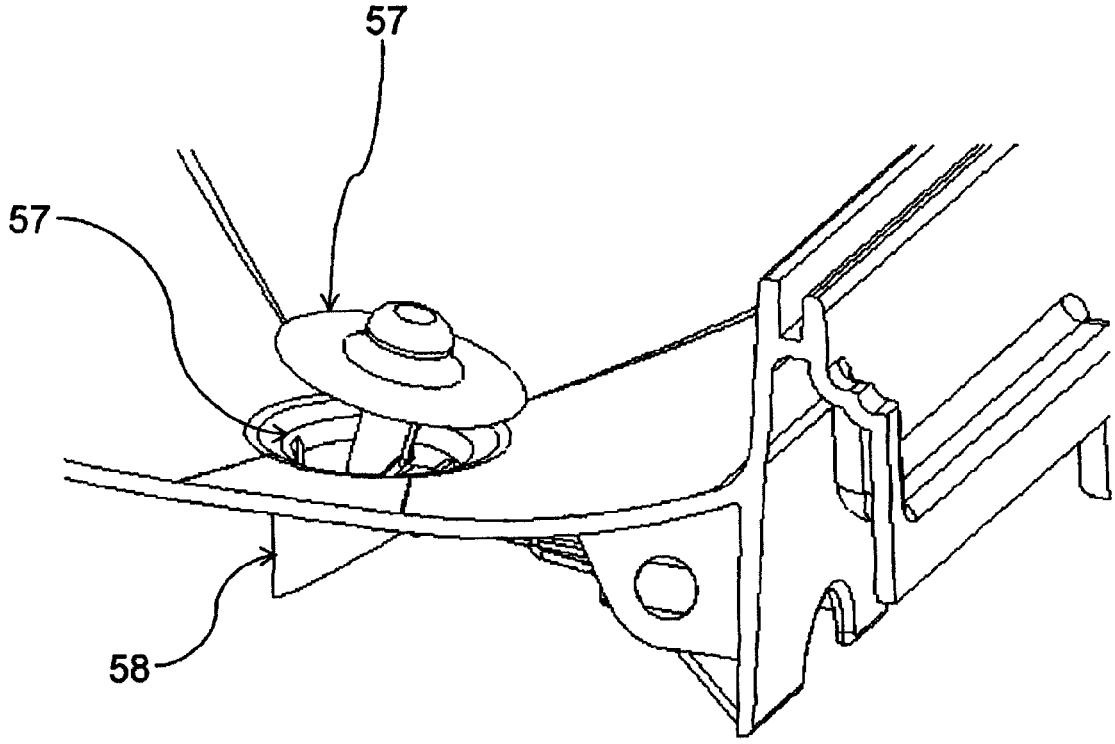
FIG. 27 shows a detailed view of the drain opening of the tank and the plug valve of the perspective view on FIG. 26.
Figure 28:
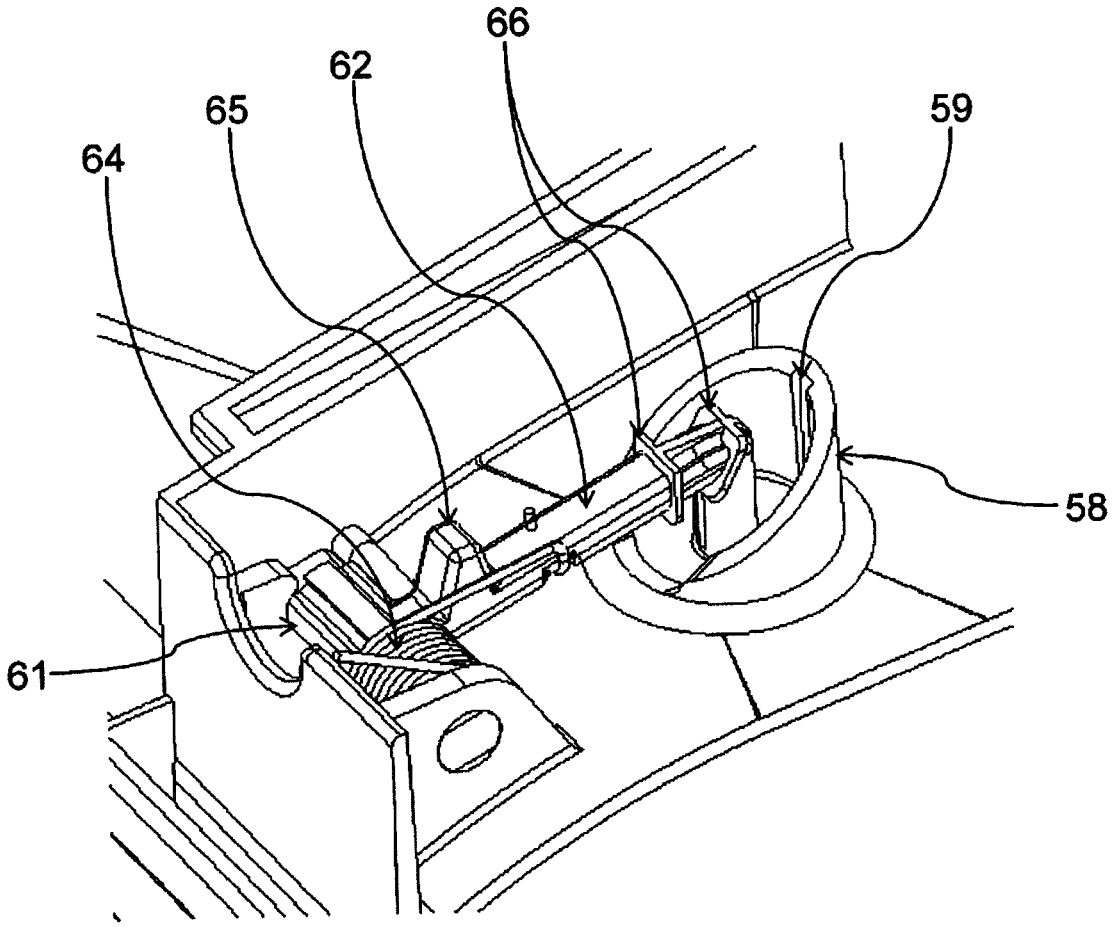
FIG. 28 shows a detailed view of the engagement of the plug valve on the detachable tank.
Figure 29:
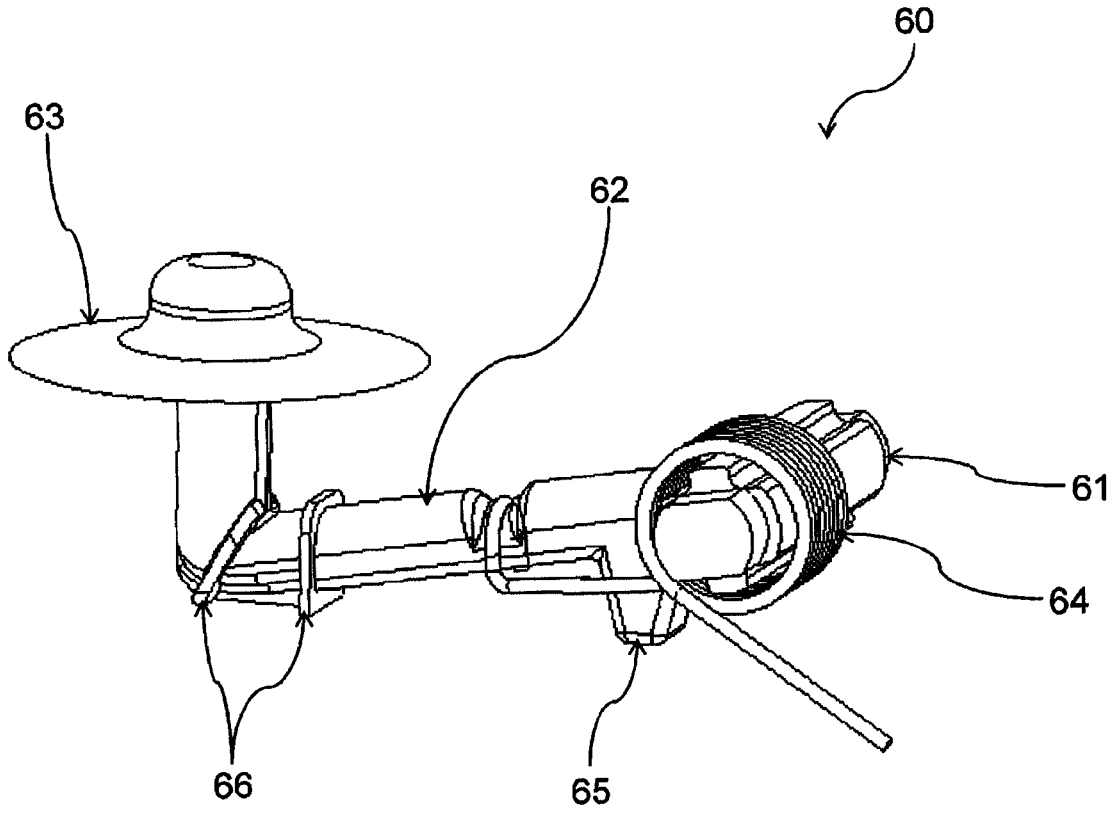
FIG. 29 shows a conventional perspective view of the complete mechanism of the plug valve.

As it can be observed in detail in FIGS. 27 to 29, the plug valve (60) comprises of a cross shaft (61) rotably coupled to a pair of brackets integrally formed on the tray element (51); an angular bent arm (62) with a first end perpendicularly joined to said rotating shaft (61); and a resilient plug element (63) coupled to a second end of say angular bent arm (62), said resilient plug element (63) is specially designed to seal the passage of fluid through the drain opening (57) due to the force exerted on the valve (60) by a torsion spring (64) attached to the said rotating shaft (61). Furthermore, there is a cam follower-type flange (65), integrally formed on a portion of the angular bent arm (62) that, once the detachable tank (50) is fully assembled to the case structure (10), comes in contact with a cam-type protrusion (19) formed in said case (10), causing the force exerted by the torsion spring (64) of the valve (60) to be overcome when said valve (60) is pushed upwards to the open position.

Together with the previous statements, the drain opening (57) of the tank comprises a tubular element (58) that extends downwards and has an angular cut on its final end, said tubular element (58) is used to guide the discharge of water from the tank (50) to the tray (20) in only one direction, thus preventing water spread outside the tray. Said tubular element (58) has at least one channel-type groove or recess (59) longitudinally formed along the inner surface of it, in order to prevent small quantities of water waste to be stuck in said tubular element due to the capillary effects and eventually prevent the water waste to freeze causing seal problems between the drain opening (57) and the plug valve (60).

Additionally, as it can be specially noted in FIGS. 28 and 29, said plug valve (60) has at least one water diversion flap (66) preferably arranged on the angular bent arm (62) of it to prevent any residual water discharged from the drain opening (57) to reach the torsion spring (64) and come in contact with the same, and causing said spring (64) to freeze, consequently producing a malfunction. In a preferred embodiment of this invention, a pair of diversion flaps (66) is arranged in a tab style around the angular bent arm (62) of the valve (60), in an area near the discharge of the drain opening (57).

Nonetheless, it is important to point out that the detachable tank (50) can be mounted in a sliding manner to the case structure (10), preferably through matching coupling rails or pads (67) formed on both sides, as well as snap-on clamping elements (68) such as deformable flanges, clips, or any other adequate media.

Figure 3:
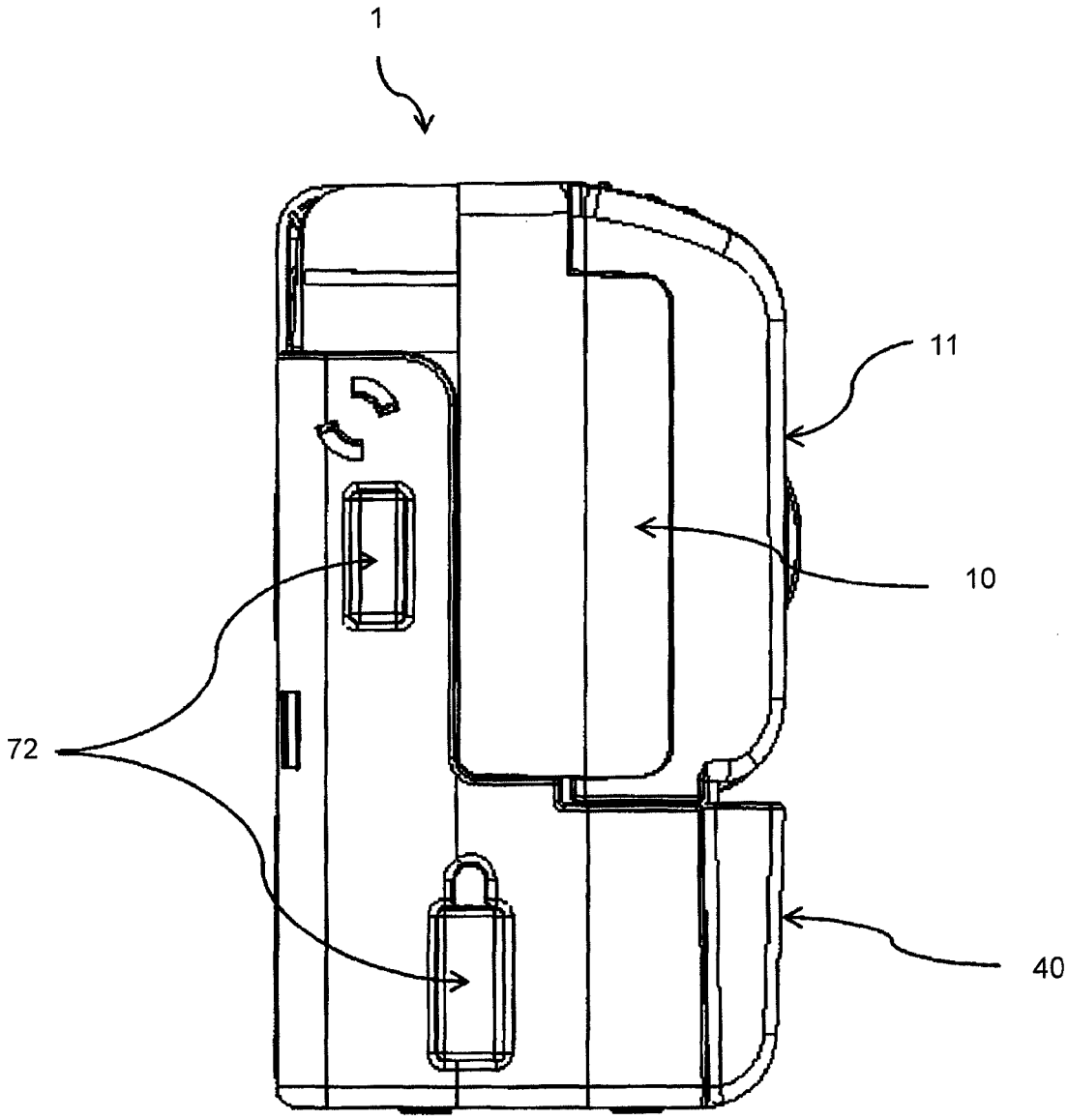
FIG. 3 shows a left side view of the ice making device of FIG. 1.
Figure 4:
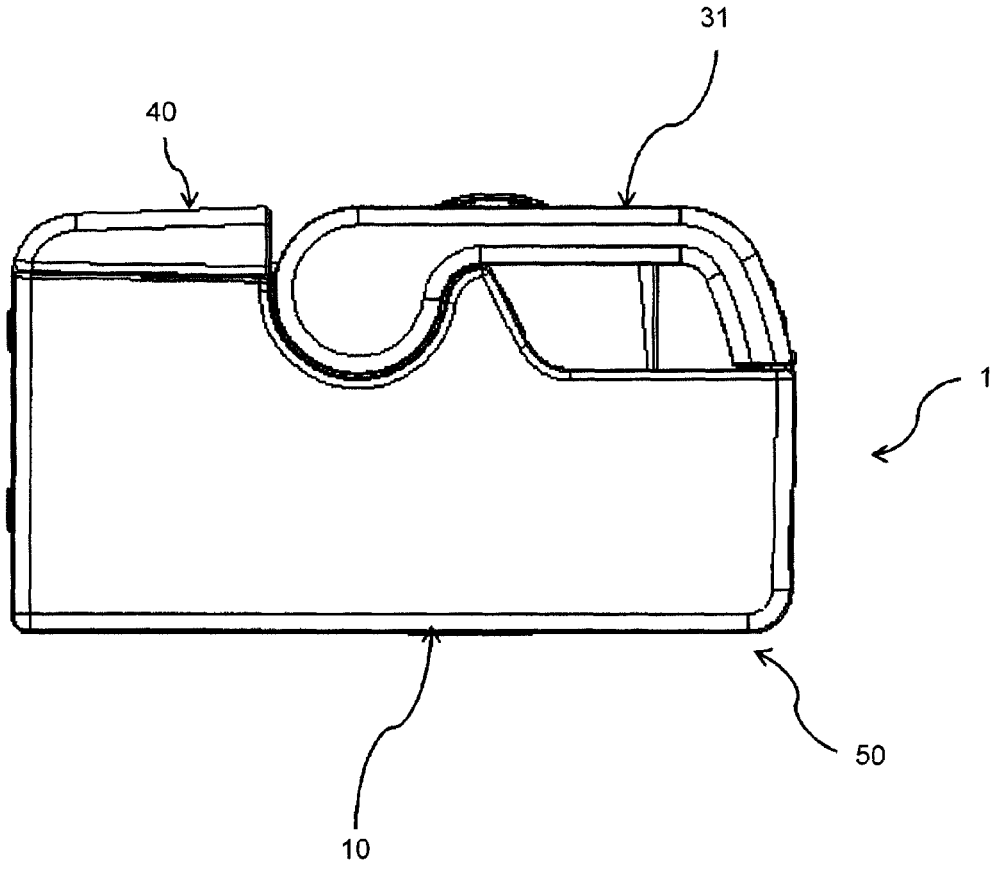
FIG. 4 shows a right side view of the ice making device of FIG. 1.
Figure 5:
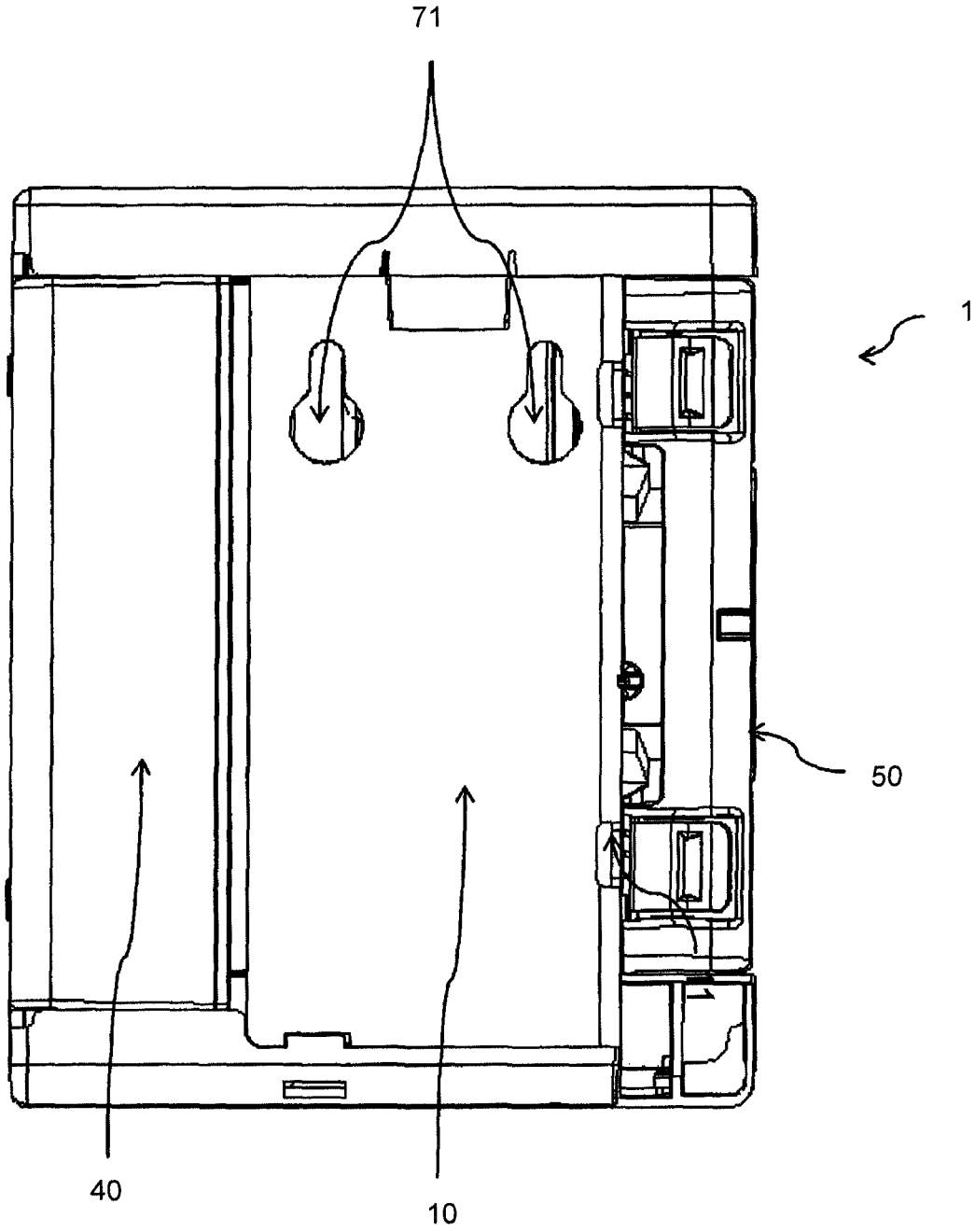
FIG. 5 shows a rear view of the ice making device of FIG. 1.
Figure 6:
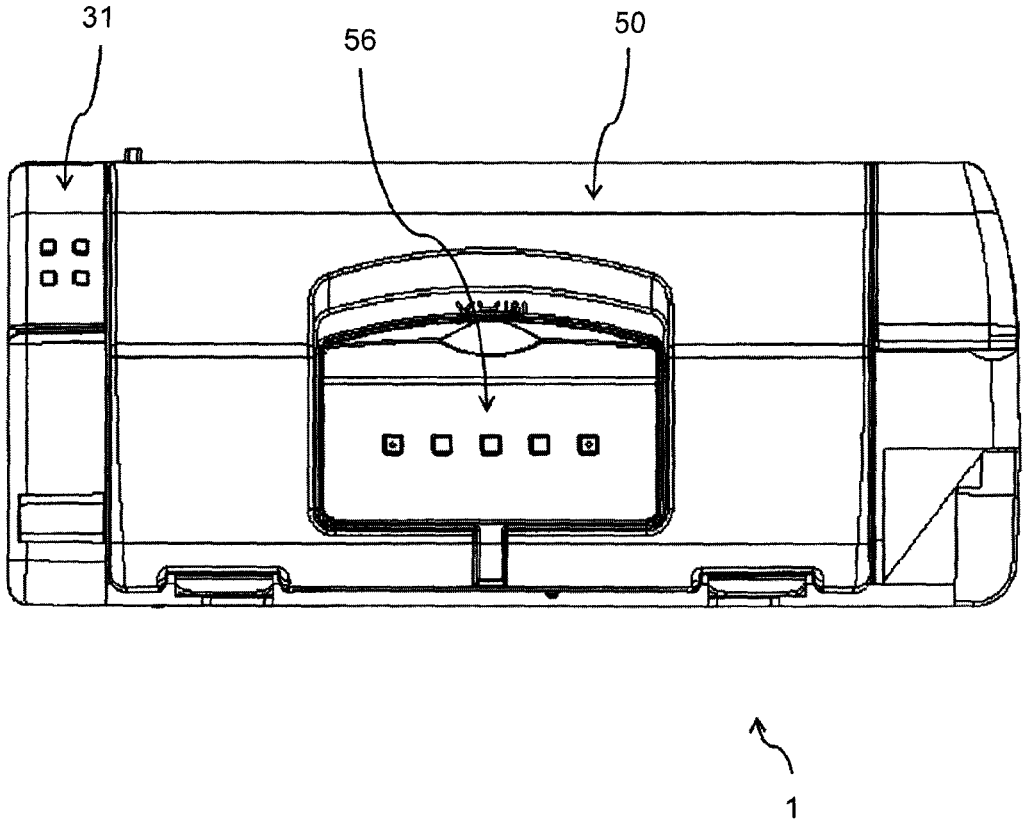
FIG. 6 shows a top view of the ice making device of FIG. 1.
Figure 7:
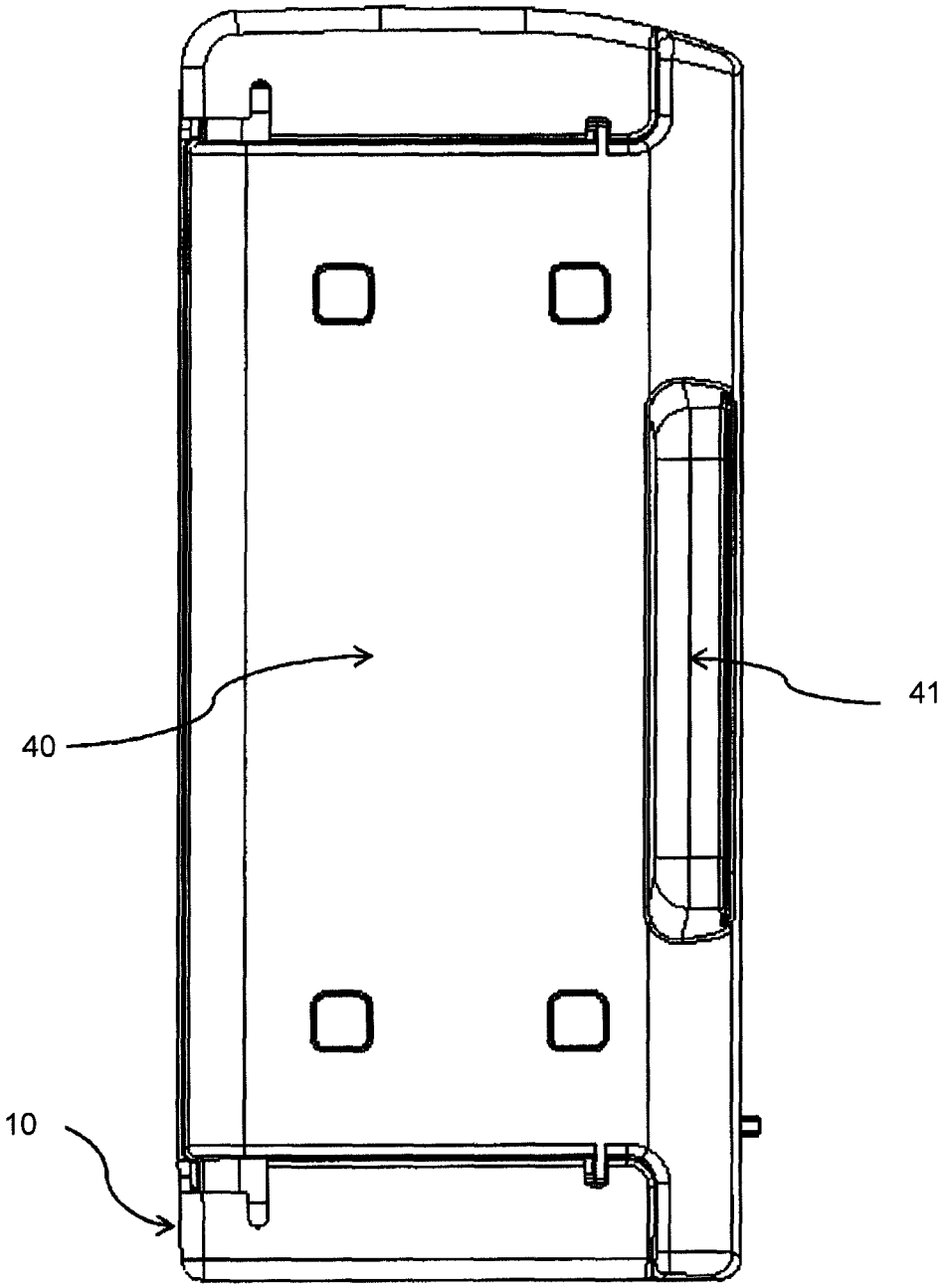
FIG. 7 shows a bottom view of the ice making device of FIG. 1.
Figure 8:
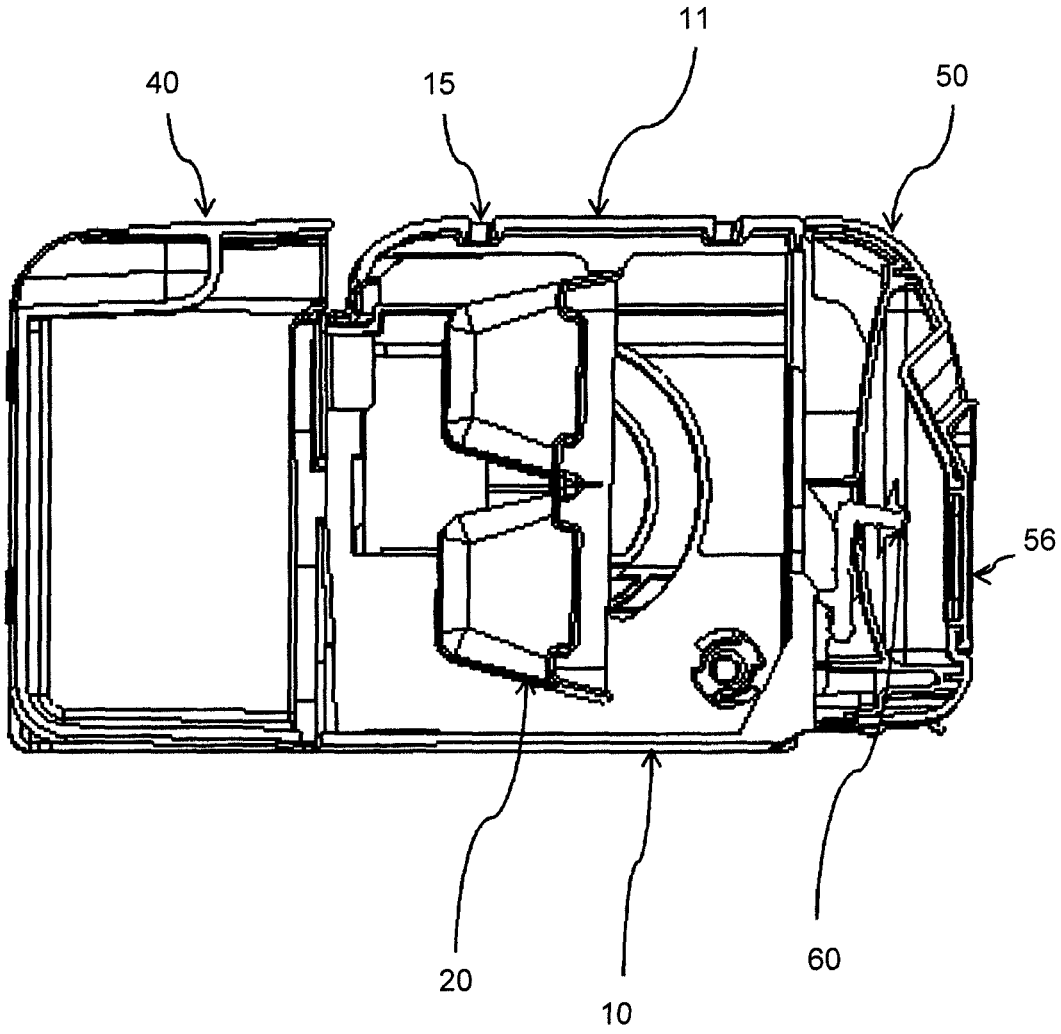
FIG. 8 shows a cross section view of the ice making device according to the present invention, taken along the line A-A' of FIG. 2.
Figure 9:
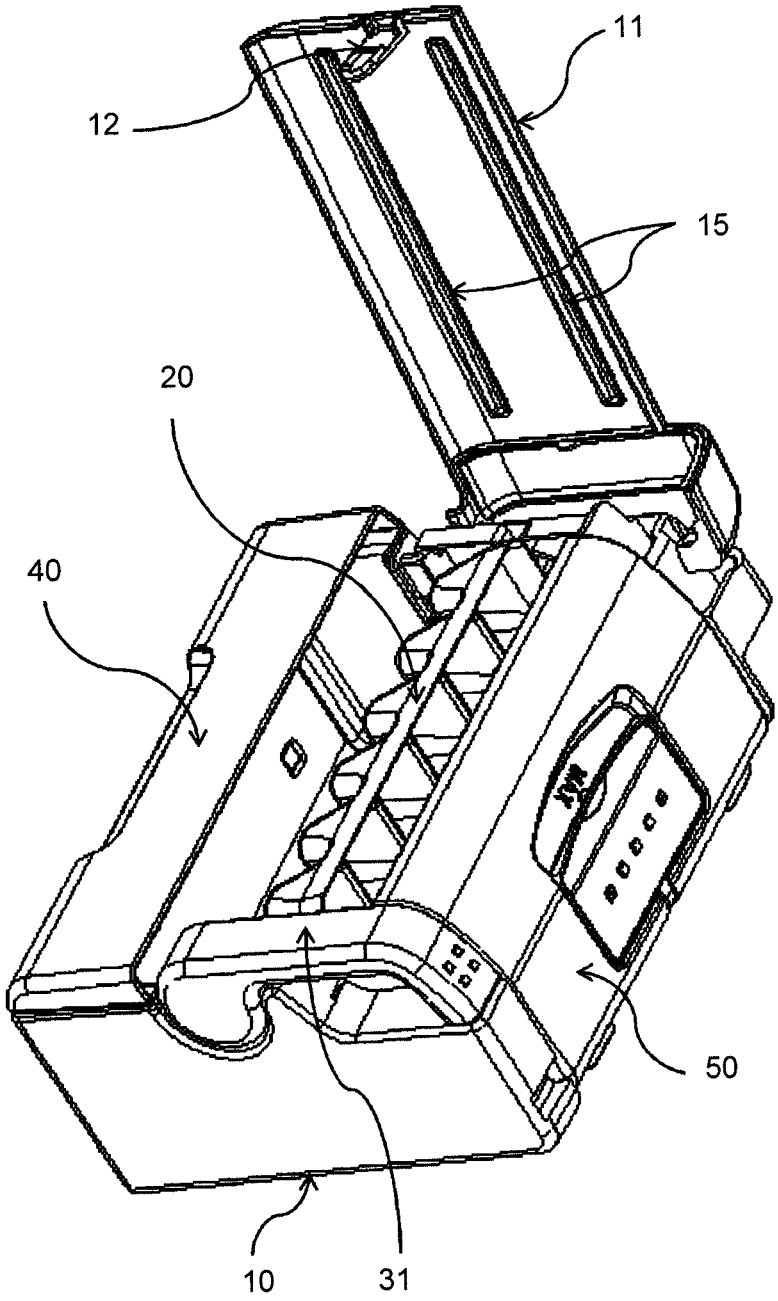
FIG. 9 shows a conventional perspective view of the ice making device of FIG. 1 with the hinged door of the main case in an open position.
Figure 10:
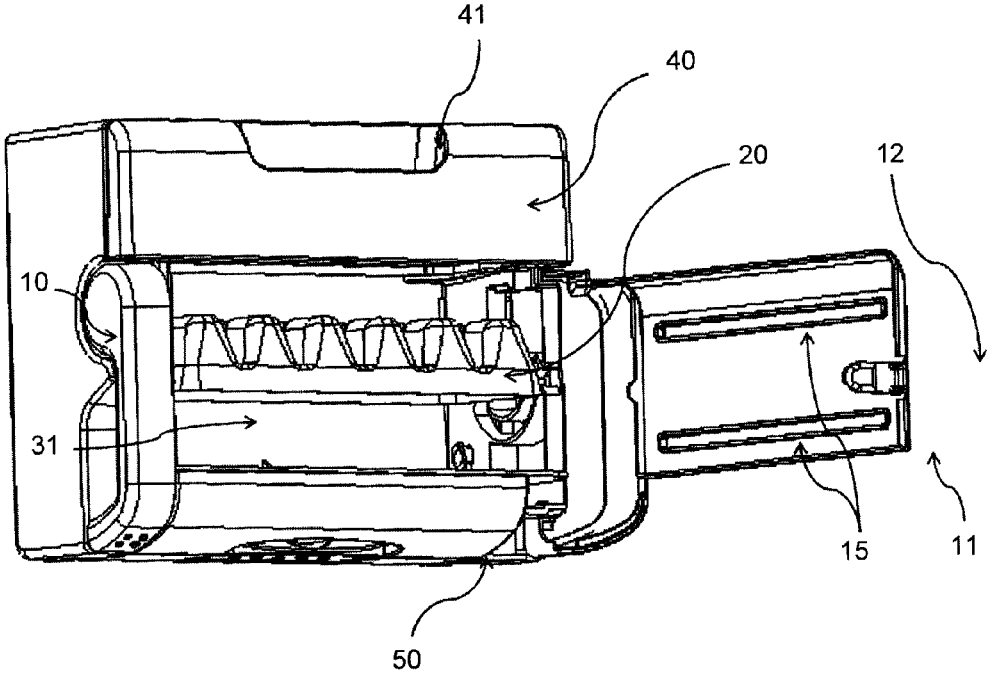
FIG. 10 shows a front perspective view of the ice making device of FIG. 1 with the hinged door of the main case in an open position.
Figure 11:
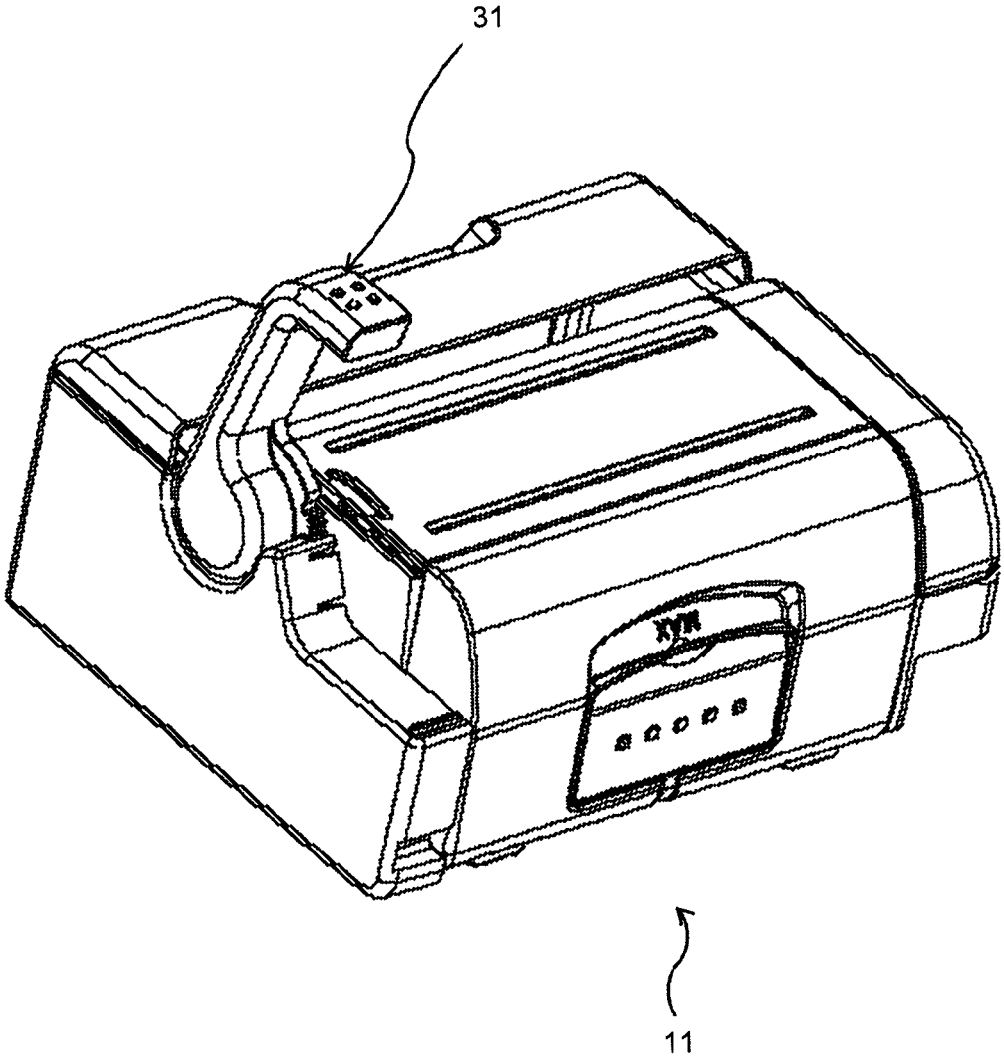
FIG. 11 shows a conventional perspective view of the ice making device of FIG. 1 with the lever of the drive transmission mechanism on the tray in actuated position.
Figure 12:
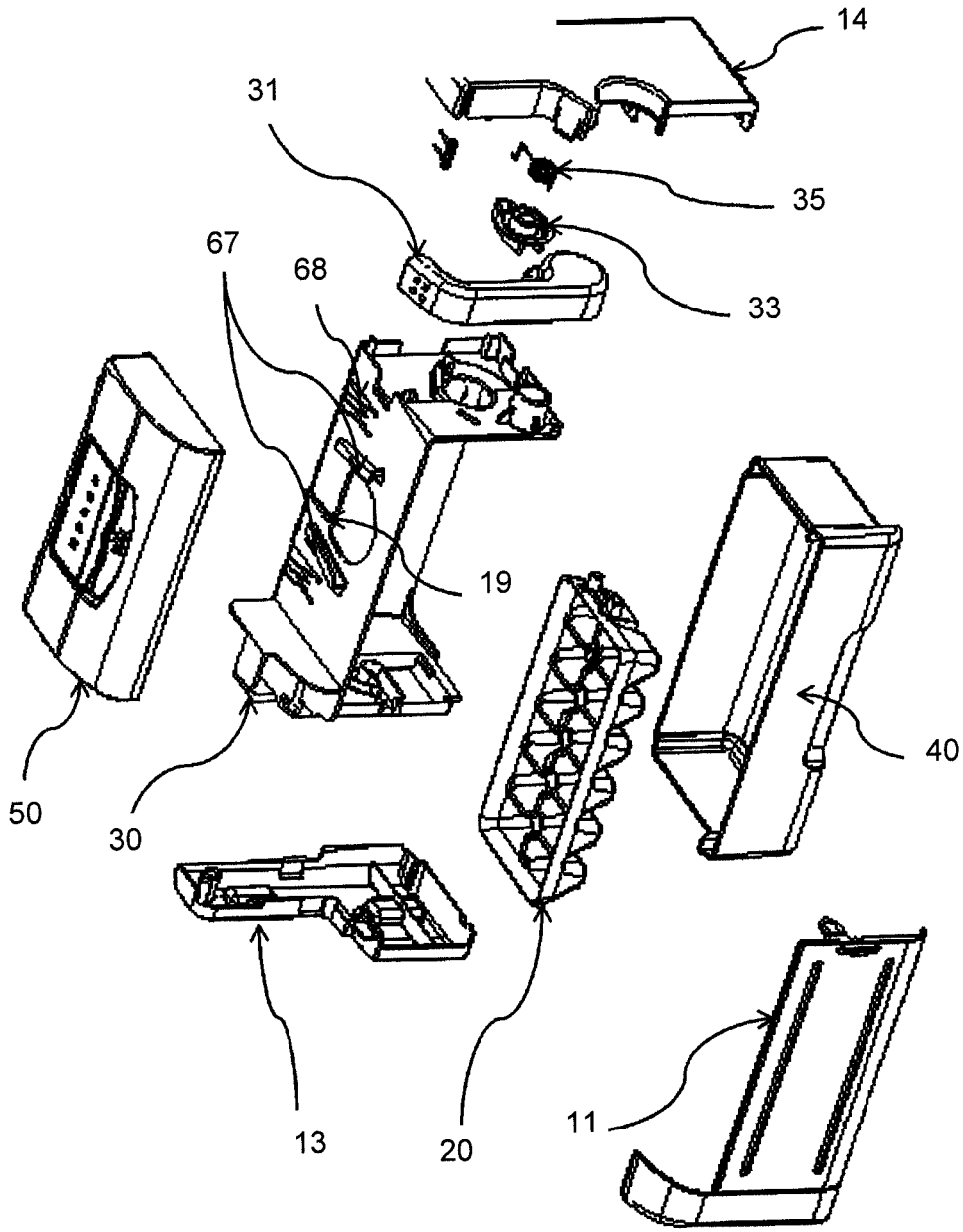
FIG. 12 shows a conventional exploded perspective view of the ice making device of FIG. 1.
Figure 13:
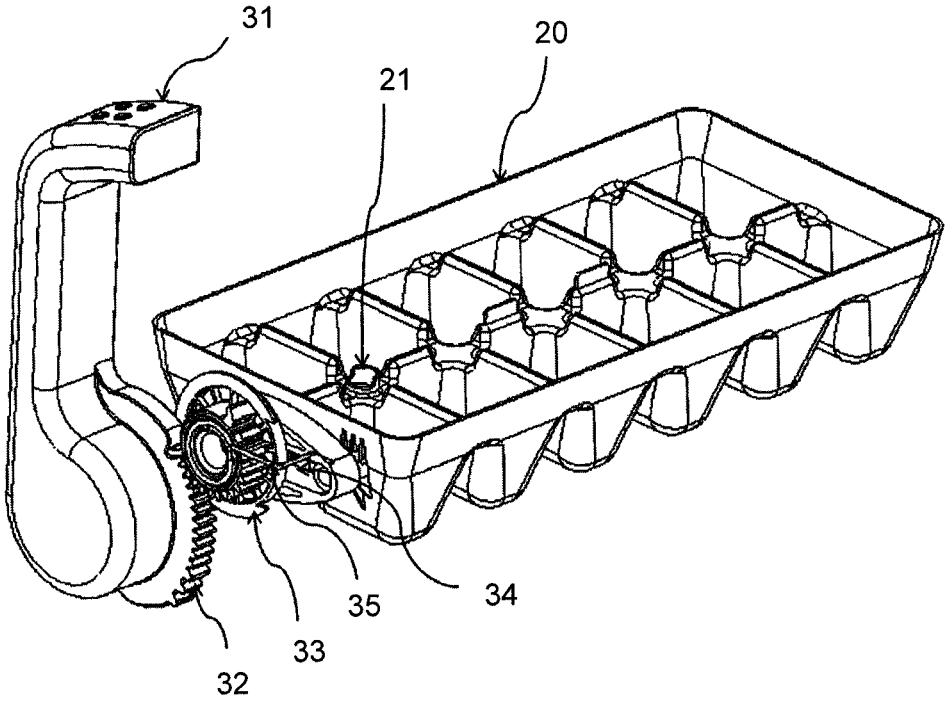
FIG. 13 shows a conventional perspective view of the drive transmission mechanism with the ice making tray coupled to it.
Figure 14:
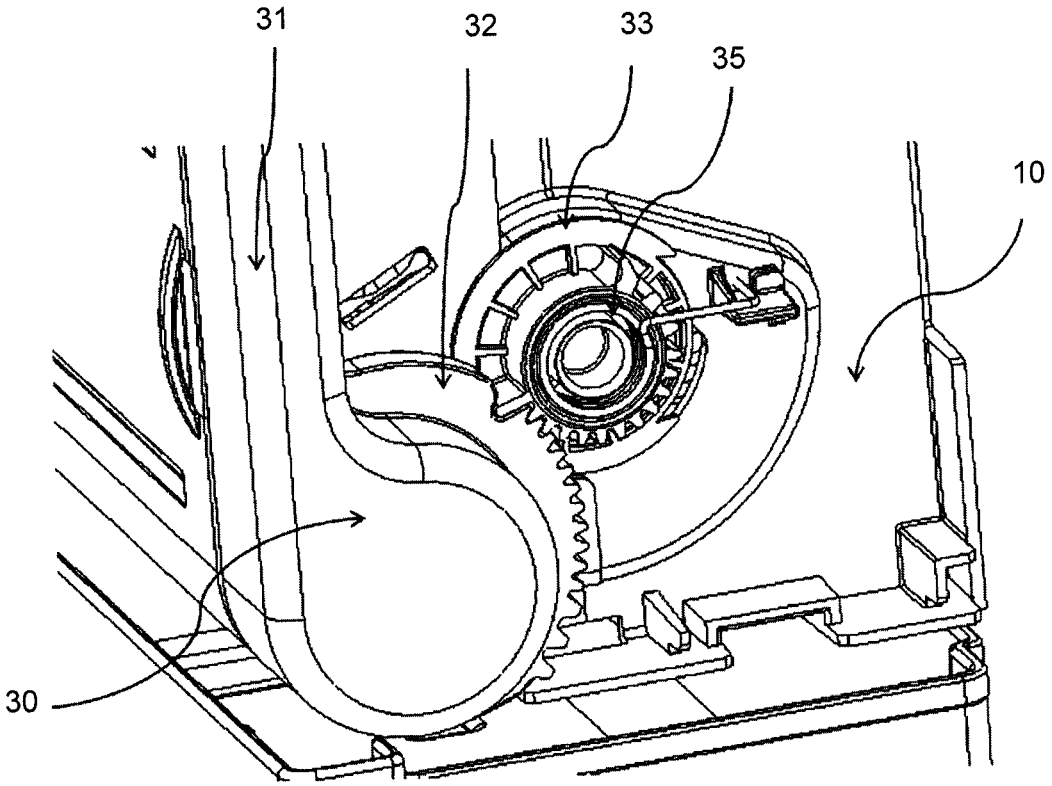
FIG. 14 shows a detailed view of the drive transmission mechanism assembled to the main case.
Figure 15:
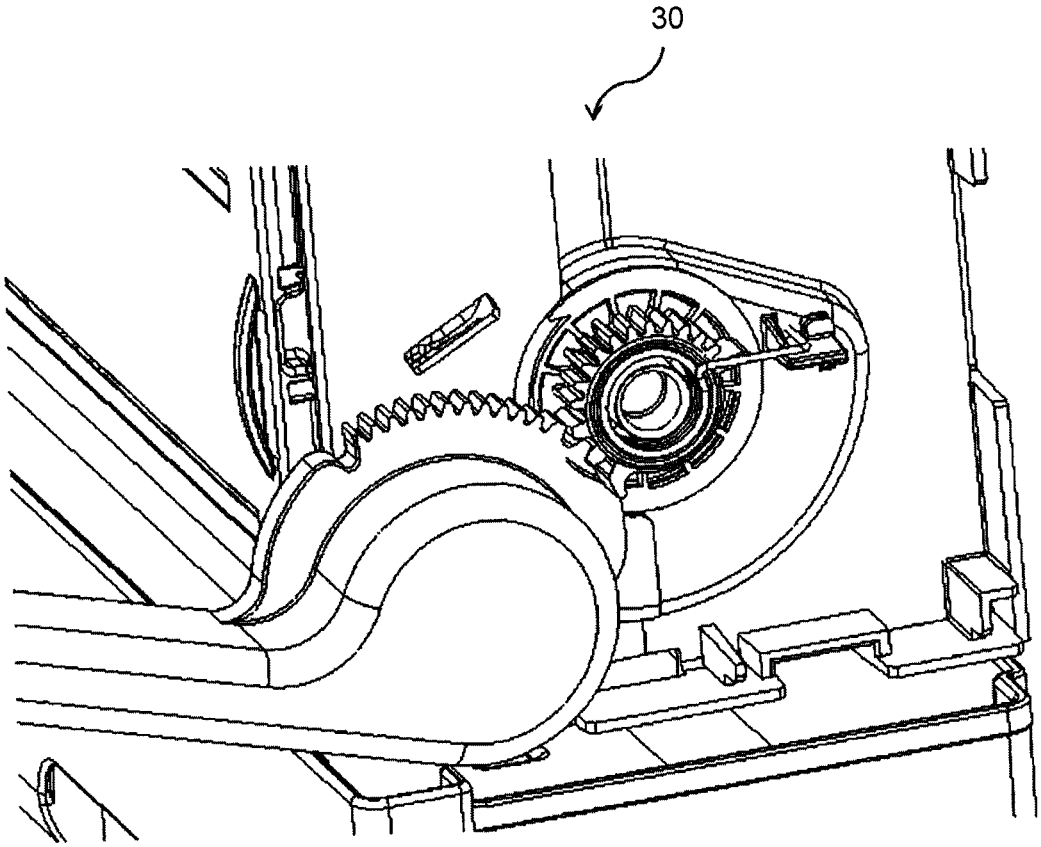
FIG. 15 shows a detailed view of the drive transmission mechanism assembled to the main case in its actuated position.
Figure 16:
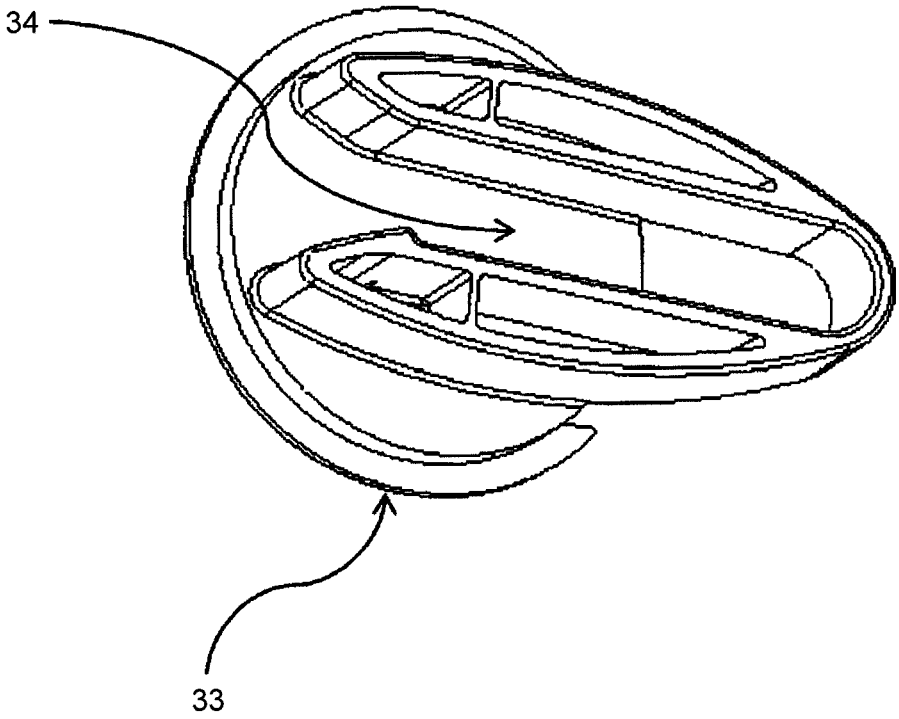
FIG. 16 shows a conventional perspective view of the rear portion of the second gear element of the drive transmission mechanism, specifically of the guiding channel for the tray assembly.

Lastly, as it can be observed in FIGS. 3 and 5, the ice making device comprises means specially designed so that it can be mounted in a detachable way to the inner cover or liner of a domestic refrigerator. Specifically, at the rear portion of case structure (10) there is at least one assembling grommet (70) designed to receive and hold the bolt head (not illustrated) formed on said refrigerator liner. Moreover, on a side of said case (10) there is at least one groove (71) designed to receive the protrusion (not illustrated) also formed on the refrigerator liner.

Modifications to the structure described in the present invention, can be made by those skilled in the art. Thus, it should be noted that the present description refers to the preferred embodiments of this invention, which are for illustrative purposes only, and should not be understood as a limitation of the invention. All modifications made without departing from the spirit of the invention, such as adapting two or more ice making trays on the device, adapting additional tanks or tank divisions, etc. should be considered within the scope of the appended claims.

The invention claimed is:

1. An ice making device with a detachable tank for the automatic supply of water, comprising:

a main case structure that has a hinged door coupled at the front; an ice making tray detachably disposed inside said case structure;

an ice cube container mounted in a sliding manner at a bottom portion of the case structure;

a drive transmission mechanism which allows the rotation of said ice making tray in a predetermined angle, said drive transmission mechanism is made up of a manually actuated lever pivotally coupled from one of its ends to the case structure and it has a first gear element integrally formed on said end of the lever, and a second gear element coupled on one side to the said first gear element in a serrated way and on another side to said ice making tray; and wherein the detachable tank mounted in a sliding manner to an upper portion of said case structure that is used to hold water and, once mounted in its place in said case structure, to automatically supply water directly into the ice making tray through a drain opening at the bottom of said tank;

wherein said water supply through said drain opening is controlled by a plug valve coupled in a hinged way to the bottom portion of said tank and it is held in a closed position due to the force exerted by a torsion spring attached to it until said force is overcome once a protrusion arranged in said case structure comes in contact and pushes the valve, when the tank is coupled to the case structure; and wherein said plug valve has at least one water diversion flap to prevent water waste from the drain opening to come in contact with the torsion spring preventing its freezing.

2. An ice making device with a detachable tank according to claim 1, wherein: the drain opening at the bottom portion of the tank additionally comprises a tubular element that extends downwards to guide the discharge of water in one direction;

said tubular element has an angular cut on its final end and has at least one channel or recess longitudinally along the same, to prevent water waste to be stuck in said tubular element.

3. An ice making device with a detachable tank according to claim 1, wherein: the drive transmission mechanism allows the rotation of the ice making tray in an angle range from approximately 140 degrees to approximately 160 degrees, and an additional range from approximately 20 degrees to approximately 30 degrees for torsion of the same.

4. An ice making device with a detachable tank according to claim 1, wherein: the ice making tray has a portion of a central rotating shaft and a decentralized cam follower element on both ends.

5. An ice making device with a detachable tank according to claim 4, wherein: one end of said ice making tray is assembled to the case structure through a guiding channel formed on a lateral end of it, and the other end is assembled to the drive transmission mechanism through a guiding channel formed on the second gear element.

6. An ice making device with a detachable tank according to claim 5, wherein: either end of said ice making tray can be indistinctly assembled to the guiding channel formed on the second gear element.

7. An ice making device with a detachable tank according to claim 4, wherein: said ice making tray has at least an opening in it to prevent overfilling.

8. An ice making device with a detachable tank according to claim 1, wherein: the detachable tank can be mounted in a sliding manner to the case structure through matching coupling pads and clamping tabs.

9. An ice making device with a detachable tank according to claim 1, wherein: the detachable tank has a fill opening at the upper portion and a cap to close said opening.

10. An ice making device with a detachable tank according to claim 1, wherein: the detachable tank comprises a tray element and a cover element engaged by tabs and/or snap-on clamping elements, and tightly sealed by an elastic O-ring-type seal arranged between them.

11. An ice making device with a detachable tank according to claim 1, wherein: the hinged door coupled at the front of the case structure can be operated to allow access to the ice making tray and remove it and put it back for cleaning and maintenance purposes.

12. An ice making device with a detachable tank according to claim 1, wherein: said hinged door has at least an opening in the same to favor air circulation through it.

13. An ice making device with a detachable tank according to claim 1, wherein: said device also has coupling media specially designed so that it can be detachably mounted on the inner case or liner of a freezing compartment of a domestic refrigerator.

14. An ice making device with a detachable tank according to claim 13, wherein: said coupling media comprise, at least, an assembling grommet and, at least, a groove.

15. A domestic refrigerator comprising:

a freezing compartment with an inner cover or liner;

an ice making device such as the one described in claim 1 detachably mounted to said liner by means of coupling elements integrally formed on said liner.

16. The domestic refrigerator according to claim 15, wherein: said coupling elements integrally formed on the liner consist at least of one bolt head and at least one protrusion, matching respectively with at least one assembling grommet and, at least, one groove formed on the ice making device.

17. A domestic refrigerator comprising:

a freezing compartment with an inner cover or liner;

an ice making device such as the one described in claim 13 detachably mounted to said liner by means of coupling elements integrally formed on it.

18. A domestic refrigerator comprising:

a freezing compartment with an inner cover or liner;

an ice making device such as the one described in claim 14 detachably mounted to said liner by means of coupling elements integrally formed on said liner.

* * * * *